United States Patent [19]

Hibino

[11] Patent Number: 4,815,133

[45] Date of Patent: Mar. 21, 1989

[54] SOUND FIELD PRODUCING APPARATUS

[75] Inventor: Masahiro Hibino, Hyogo, Japan

[73] Assignee: Mitsubishi Denki Kabushiki Kaisha, Tokyo, Japan

[21] Appl. No.: 11,058

[22] Filed: Feb. 4, 1987

[30] Foreign Application Priority Data

Feb. 20, 1986 [JP] Japan ..... 61-35857

[51] Int. Cl.[4] ..... H04R 5/02

[52] U.S. Cl. ..... 381/24

[58] Field of Search ..... 381/1, 17, 18, 19, 24

[56] References Cited

U.S. PATENT DOCUMENTS

| | | | |
|---|---|---|---|
| 3,757,047 | 9/1973 | Ito et al. | 381/18 |
| 3,761,631 | 9/1973 | Ito et al. | 381/18 |
| 4,218,585 | 8/1980 | Carver . | |
| 4,308,423 | 12/1981 | Cohen | 381/1 |
| 4,394,536 | 7/1983 | Shima et al. . | |
| 4,594,729 | 6/1986 | Weingartner | 381/18 |
| 4,612,663 | 9/1986 | Holbrook et al. | 381/18 |
| 4,635,288 | 1/1987 | Stadius | 381/119 |
| 4,677,674 | 6/1987 | Snyder | 381/119 |

*Primary Examiner*—Forester W. Isen

*Attorney, Agent, or Firm*—Wolf, Greenfield & Sacks

[57] ABSTRACT

A sound field producing apparatus operatively connected to a stereophonic sound source and adapted to supply audio signals to a loudspeaker system, comprising an indirect sound extracting circuit for extracting indirect sound components by extracting a difference signal representing the difference between right and left input signals. The difference signal is phase-inverted to obtain an inverted difference signal. Two mixing circuits are provided for mixing the right and left input signal, the difference signal and the inverted difference signal to supply mixed signals. Loudspeakers are disposed on the right and left both in front of and to the rear of a listener and are driven by the mixed signals from the mixing circuits.

6 Claims, 2 Drawing Sheets

SOUND FIELD PRODUCING APPARATUS

BACKGROUND OF THE INVENTION

1. Technical Field of the Invention

The present invention relates to a sound field producing apparatus which can set a sound field in accordance with a listener's preference by a simple operation in a stereophonic musical sound reproducing apparatus.

2. Prior Art

It has hitherto been the practice to use a method such as the following to make the sound field comfortable in a car audio system:

(i) a loudspeaker system is constituted as a multi-system by locating a total of four loudspeakers such that two loudspeakers are respectively disposed on the right and left sides at the front end of the car and the remaining two loudspeakers are respectively disposed on the right and left sides at the rear; and (ii) electrically delayed sound components are mixed with the reproduced sounds, thereby giving an apparent reverberation effect.

According to method (i), the balances of the amount of sound in the right and left directions and in the front and rear directions can be adjusted by attenuators. Differences in listening positions can be allowed for by adjustment of the sound amount balances. Therefore, this method offers the advantage of being able to realize a comfortable sound field in which a listener is surrounded by the sounds at any given listening position. However, with this method, a feeling of expanse and reverberation of sounds cannot be obtained.

According to method (ii), a feeling of reverberation can be obtained and a feeling of expanse of sounds can be achieved in dependence on the listening position of the listener. However, according to this method, since a large amount of electrically delayed signals are also mixed with the sound source whose sound image needs to be formed at a central position, a feeling of localization of sound sources is lost for vocal songs or voice signals from a radio or the like. Accordingly, an unnatural feeling is undoubtedly caused.

In addition, there is a further problem which is common to both methods (i) and (ii), that is, the necessity for the listener to manually operate a number of variable resistors in order to correct the sound field, these operations being quite troublesome.

SUMMARY OF THE INVENTION

Accordingly, a general object of the invention is to overcome the above-stated problems of the prior art.

Another object of the invention is to provide a sound field producing apparatus which does not harm the desired feeling of localization of vocal sounds or the sound from a radio and which can give listeners a feeling of expansive sounds.

A further object of the invention is to provide a sound field producing apparatus which assures a listening ambience substantially equal to that of a listening room or a concert hall, even if installed in a small space such as the passenger compartment of an automobile.

To accomplish the above-stated objects, the sound field producing apparatus according to the present invention comprises indirect sound extracting means for extracting indirect sound components included in right and left stereo input signals by obtaining a difference signal representing the difference between these input signals. An inverted difference signal is also obtained by inverting the phase of the difference signal by phase inverting means. Mixing means is provided for mixing the difference signal with one of the right and left input signals along with the inverted difference signal being mixed with the other of the right and left input signals. The mixing means is operable to mix these signals at a variable mixture ratio for each signal.

In one embodiment of the invention, the sound field producing apparatus comprises a first mixing section, a second mixing section and a control signal generating section. The first mixing section supplies a mixed signal to front loudspeakers disposed on the right and the left in front of a listener, and the second mixing section supplies a mixed signal to rear loudspeakers disposed on the right and the left to the rear of the listener. The control signal generating section generates and supplies a control signal to the first and second mixing sections in order to respectively set a desired mixture ratio in accordance with the listener's preference. Accordingly, the mixture ratio is settable independently in each mixing section and the indirect sound components included in the mixed signal are variable. This ensures that a sound field suitable for reproduction of an ordinary stereophonic sound can be established in a small space having large sound absorbing characteristics. Moreover, a comfortable sound field matching the listener's preference can be produced by a simple operation, which enhances the practical value of the sound field producing apparatus of the present invention.

The above and other objects, advantages and features of the invention will become apparent from a consideration of the following description taken in connection with the accompanying drawings.

DETAILED DESCRIPTION OF THE PREFERRED EMBODIMENT

An embodiment of the present invention will now be described with reference to the drawings.

Figure 1:
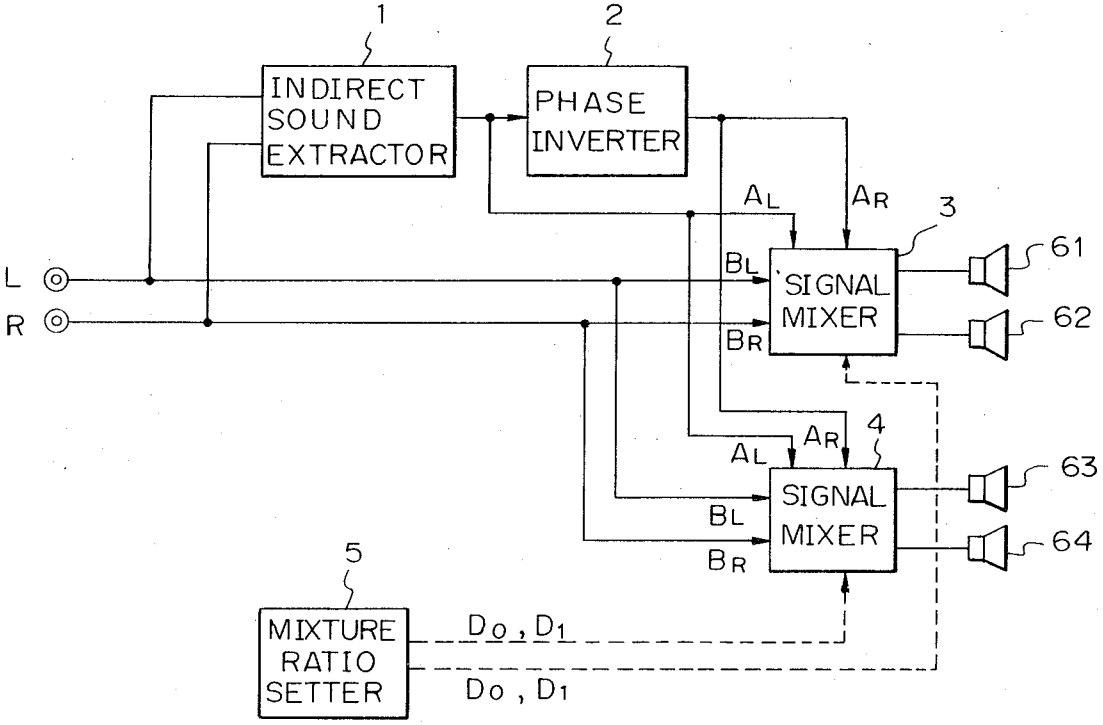
FIG. 1 is an electrical circuit block diagram showing one embodiment of a sound field producing apparatus according to the present invention.

FIG. 1 is a block diagram showing the structure of an electrical circuit of one embodiment of a sound producing apparatus according to the present invention. A left channel stereo signal L is supplied to one of the input terminals and a right channel stereo signal R is supplied to the other of the input terminals. These stereo signals have been reproduced from a cassette player, a compact disc player, an FM stereo receiver or the like.

Left and right channel stereo signals L and R are fed to an indirect sound extracting circuit 1 whose output $A_L$ is applied to a phase inverting circuit 2 and signal mixing circuits 3 and 4. Signal mixing circuits 3 and 4 are also supplied with left and right stereo signals L and R as signals $B_L$ and $B_R$ and the output signal $A_R$ from phase inverting circuit 2. Signal mixing circuits 3 and 4 are operable to mix the input signals and amplify the mixed signals to drive front speakers 61 and 62 and rear speakers 63 and 64, respectively. In order to change the mixture ratio in signal mixing circuits 3 and 4, mixture ratio setting circuit (mixture ratio control circuit) 5 is provided to control the mixture ratio in signal mixing circuits 3 and 4.

FIGS. 2–5 show practical examples of the structural components shown in FIG. 1.

Figure 2:
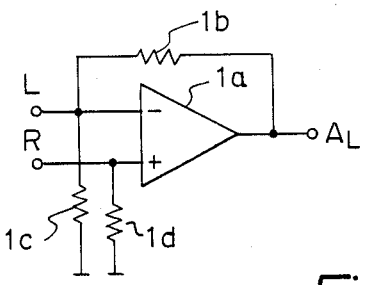
FIG. 2 shows an example of an electrical circuit executing the function of the indirect sound extracting circuit shown in FIG. 1.

The indirect sound extracting circuit 1 includes a differential amplifier 1*a* and resistors 1*b* to 1*d* as shown in FIG. 2. This circuit outputs a difference signal representing the difference between left and right signals L and R.

Figure 3:
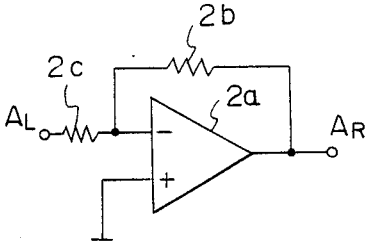
FIG. 3 shows, an example of an electrical circuit executing the function of the phase inverting circuit shown in FIG. 1.

The phase inverting circuit 2 includes an operational amplifier 2*a* and resistors 2*b* and 2*c* as shown in FIG. 3.

Figure 4:
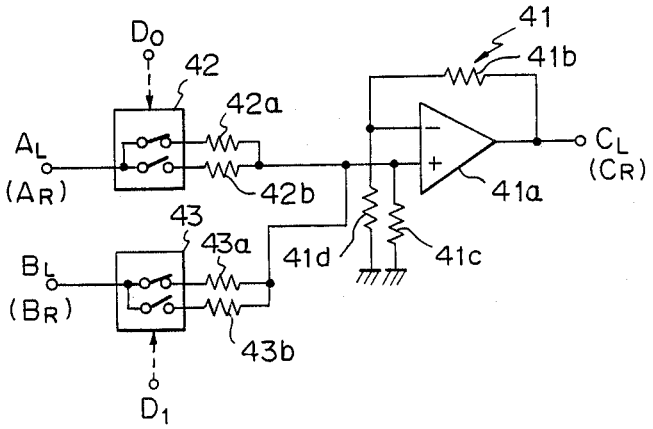
FIG. 4 shows an example of an electrical circuit executing the function of the signal mixing circuit shown in FIG. 1.

Each of signal mixing circuits 3 and 4 has a pair of mixing circuits of the same structure, one for mixing signals $A_L$ and $B_L$ and the other for mixing signals $A_R$ and $B_R$. FIG. 4 shows an example of a circuit for mixing signals $A_L$ and $B_L$ comprising an addition circuit 41 having an operational amplifier 41*a* and resistors 41*b* to 41*d*, and resistor switching circuits 42 and 43 for changing addition ratios by switching resistors 42*a*, 42*b*, 43*a* and 43*b*. In this example, the attenuation amounts corresponding to two resistors can be selected for input signal $A_L$ by control signal $D_0$. Similarly, two kinds of attenuation amounts can also be selected for input signal $B_L$ by control signal $D_1$. Therefore, amplified output signal $C_L$ is obtained by adding the input signals on the basis of four kinds of addition ratios in accordance with the combination of logical values of $D_0$ and $D_1$.

Figure 5:
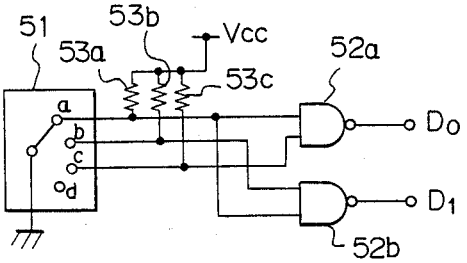
FIG. 5 shows an example of an electrical circuit executing the function of the mixture ratio setting circuit shown in FIG. 1.

The mixture ratio setting circuit 5 comprises a switch 51, NAND gate elements 52*a* and 52*b* and resistors 53*a* to 53*c*, as shown in FIG. 5. In this example, switch 51 has four contacts, so that four states can be selected. Code signals $D_0$ and $D_1$ of two bits are output by AND elements 52*a* and 52*b* of two inputs in accordance with the switch position. The code signals correspond to the control signals for signal mixing circuits 3 and 4 as previously described.

The operation of the sound field producing apparatus according to this embodiment of the invention will now be described referring to FIGS. 1–5. Such signals as musical reproduced signals L and R from a CD player or the like are input to signal mixing circuits 3 and 4 and also simultaneously input to indirect sound extracting circuit 1. Indirect sound extracting circuit 1 obtains a difference signal L-R representing the difference between the two inputs by the circuit as shown in FIG. 2, thereby virtually extracting the indirect sound components recorded with the musical sounds. This is done in consideration of the fact that although the sound waves which directly come from the sound sources such as musical instruments and the like are substantially in phase in the right and left channels at the time of making the stereophonic recording, the waves reflected from the wall surfaces, floor, and the like, i.e., indirect sounds, have various phases in the right and left channels. Therefore, by obtaining the difference between the right and left channel signals, the in-phase direct sound components are removed but the indirect sound components are extracted and not removed.

The signal L-R, i.e. $A_L$, which includes a large amount of indirect sound components extracted by indirect sound extracting circuit 1 is input to signal mixing circuits 3 and 4 together with the signal R-L, i.e. $A_R$, which is the phase inverted signal of $A_L$ by phase inverting circuit 2.

Signal mixing circuit 3 outputs signals to drive front loudspeakers 61 and 62. Likewise, signal mixing circuit 4 outputs signals to drive rear loudspeakers 63 and 64. Both of those mixing circuits include two independent mixers, one for the left channel and the other for the right channel. In the case of the left channel, two different input signals $A_L$ and $B_L$ are mixed at four different mixture ratios in accordance with the switching mode of the analog switches, as can be understood from the circuit constitution shown in FIG. 4. The operation of the mixer for the right channel is similar to this. In FIG. 4, input and output signals for the right channel are indirected in parentheses.

Input signal $A_L$ is the output signal from indirect sound extracting circuit 1, and input signal $B_L$ is the direct reproduced left signal L. Output signal $C_L$ of this circuit is the signal obtained by mixing inputs $A_L$ and $B_L$ at a predetermined mixture ratio and one of the front loudspeaker 61 arranged on the left side is driven by this signal $C_L$. On the other hand, with respect to the right side channel signal system, input signal $A_R$ is the output signal from phase inverting circuit 2, and input signal $B_R$ is the direct reproduced right signal R. The other of the front loudspeakers 62 on the right side is driven by output signal $C_R$. Signal mixing circuit 4 for driving the rear loudspeakers also operates in a manner similar to that stated above. It should be noted that the mixture ratios on the front and rear sides can be independently set. These ratios are set by control signals $D_0$ and $D_1$ which are generated from control signal generator as shown in FIG. 5. Although only the circuit for one of the signal mixing circuits is shown in FIG. 5, the control circuit for the other of the signal mixing circuits is of course provided also. These control circuits are so constituted that they can independently control the mixture ratios for the front an rear sides, respectively.

The effect of the sound field producing apparatus according to the embodiment shown in FIGS. 1–5 will now be explained.

As can be understood from the above-described explanation of the operation, it is a feature of this apparatus that, as one of the loudspeaker driving signals, the indirect sound components included in the musical reproduced sounds upon recording are extracted and that the signal obtained by suitably mixing these components with the reproduced sounds is used. It is a further feature that the mixture ratios can be independently controlled at a few different levels on the front and rear sides.

Restricted spaces having large sound absorbing characteristics, such as passenger compartment of an automobile, are not comfortable sound field spaces. One of the reasons for this is that the reverberation effect is small. Therefore, as described in regard to the embodiment, by extracting the indirect sound components included in the musical sounds and by enlarging and reproducing them, it is possible to obtain an effect that enables the sound field in the passenger compartment of an automobile to resemble more closely that experienced in an ordinary room or concert hall.

However, the degree to which this effect can be obtained is inevitably dependent upon differences in possible listening positions and upon personal taste or the like. Therefore, in the sound field producing apparatus of the present invention, the mixture ratios may be set in several stages, thereby enabling mixture ratios to be selected in accordance with the listening position and taste of a listener.

Table 1 shows the relationships between the mixture ratios of the indirect sounds to the reproduced sounds on the front and rear sides and the simulated sound fields which are considered to correspond to these mixture ratios.

TABLE 1

| Mixture ratio at the front | Mixture ratio at the rear | Simulated sound field | Switch position |
|---|---|---|---|
| small | small | ordinary room | a |
| small | large | concert hall | b |
| large | large | stadium | c |
| 0 | 0 | passenger compartment of an automobile | d |

In this embodiment, four types of sound fields can be produced by a simple operation of switch 51 of the mixture ratio setting circuit shown in FIG. 5. By providing the mixture ratio setting with indications representing simulated sound fields corresponding to each switch position, a listener can select a desired sound field easily even while driving. Thus, the utility of car audio systems can be improved.

The present invention is advantageous especially in the case of listening to musical reproduced sounds in restricted spaces such as the passenger compartment of an automobile. Therefore, in the foregoing embodiment, an example has been described for use in the case of applying the present invention to car audio system, i.e., to the production of a sound field in the passenger compartment of a car. However, an effect similar to that of the foregoing embodiment can also be produced in the reproduction of stereophonic musical sounds in small rooms having large sound absorbing characteristics other than the case of a car audio system.

While a preferred form of the present invention has been described, it will be understood that various modifications may be made thereto, and it is intended that the appended claims cover all such modifications as fall within the true spirit and scope of the invention.

What is claimed is:

1. In a sound field producing apparatus operatively connected to a stereophonic sound source and adapted to supply audio frequency signals to a loudspeaker system having at least two speakers, comprising:

indirect sound extracting means for extracting indirect sound components from right and left stereo signals input thereto by obtaining a difference signal representing the difference between said right and left stereo signals;

phase inverting means for inverting the phase of said difference signal to produce an inverted difference signal;

first mixing section supplied with one of said right and left stereo signals and said difference signal for mixing said difference signal with one of said right and left stereo signals at a variable mixture ratio to supply a first mixed signal to one of said two speakers;

second mixing section supplied with the other of said right and left stereo signals and said inverted difference signal for mixing said inverted difference signal with the other of said right and left stereo signals at a variable mixture ratio to supply a second mixed signal to the other of said two speakers; and mixture radio control means having a unitary control input means for automatically generating and supplying respective control signals to said first and second mixing sections to set said mixture ratios thereto, thereby enabling a variety of sound fields to be produced.

each of said first and second mixing sections comprising two amplitude control circuits responsive to respective input signals and responsive to a respective signal to control the amplitude of the respective input signals, and an addition circuit adapted to receive the output signals from said amplitude control circuits to supply a mixed signal to the corresponding speaker, said mixture ratio control means defining the mixture ratio as the ratio between the amplitude of corresponding left or right signals input to the respective mixing sections.

2. A sound field producing apparatus as claimed in claim 1 wherein each amplitude control circuit includes a set of resistance elements connected in parallel to an input of a corresponding addition circuit and a switching circuit for selecting one of said resistance elements in response to said respective control signal.

3. A sound field producing apparatus as claimed in claim 2 wherein said mixture ratio control means includes a setting circuit for allowing said mixture ratios to be set by a manual operation of a listener and a logic circuit for generating and supplying said control signals to respective switching circuits in response to the mixture ratios set by said setting circuit.

4. In a sound field producing apparatus operatively connected to a stereophonic sound source and adapted to supply audio frequency signals to a loudspeaker system having at least two front speakers and at least a two rear speakers, comprising:

indirect sound extracting means for extracting indirect sound components from right and left stereo signal input thereto by obtaining a difference signal representing the difference between said right and left stereo signals;

phase inverting means for inverting the phase of said difference signal to produce an inverted difference signal;

first mixing section supplied with one of said right and left stereo signals and said difference signal for mixing said difference signal with one of said right and left stereo signals at a variable mixture ratio to supply a first mixed signal to one of said two front speakers;

second mixing section supplied with the other of said right and left stereo signals and said inverted difference signal for mixing said inverted difference signal with the other of said right and left stereo signals at a variable mixture ratio to supply a second mixed signal to the other of said two front speakers;

third mixing section supplied with one of said right and left stereo signals and said difference signal for mixing said difference signal with one of said right and left stereo signals at a variable mixture ratio to supply a third mixed signal to one of said two rear speakers;

fourth mixing section supplied with another of said right and left stereo signals, with respect to said third mixing section, and said inverted difference signal for mixing said inverted difference signal with said another signal at a variable mixture ratio to supply a fourth mixed signal to the other of said two rear speakers.

mixture ratio control means having a unitary control input means for automatically generating and supplying control signals to said first, second, third and fourth mixing sections to set the mixture ratios thereof, thereby enabling the mixture ratios of the reproduced sounds from said front and rear speakers to be respectively controlled to produce a variety of sound fields, and each of said first, second, third and fourth mixing sections comprising two amplitude control circuits provided for the respective input signals and responsive to a respective control signal to control the amplitude of the respective signals and an addition circuit adapted to receive and add the output signals from said amplitude control circuits to supply a mixed signal to a corresponding speaker, said mixture control means defining the mixture ratio as the ratio between the amplitudes of corresponding left or right signals input to the respective mixing sections.

5. A sound field producing apparatus as claimed in claim 4 wherein each amplitude control circuit includes a set of resistance elements connected in parallel to an input of a corresponding addition circuit and a switching circuit for selecting one of said resistance elements in response to said respective control signal.

6. A sound field producing apparatus as claimed in claim 5 wherein said mixture ratio control means includes a setting circuit for allowing said mixture ratios to be set by a manual operation of a listener and a logic circuit for generating and supplying said control signals to respective switching circuits in response to the mixture ratios set by said setting circuit.

* * * * *